US006684784B2

(12) United States Patent
Kolbe et al.

(10) Patent No.: US 6,684,784 B2
(45) Date of Patent: Feb. 3, 2004

(54) PRINTING MACHINE WITH BLOCK-CLEANING DEVICE

(75) Inventors: Wilfried Kolbe, Gülzow (DE); Klaus Schirrich, Bielefeld (DE); Wolfgang Brusdeilins, Bielefeld (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 10/370,151

(22) Filed: Feb. 18, 2003

(65) Prior Publication Data

US 2003/0159606 A1 Aug. 28, 2003

(30) Foreign Application Priority Data

Feb. 26, 2002 (EP) ..... 02004154

(51) Int. Cl.[7] ..... B41F 35/00
(52) U.S. Cl. ..... 101/425; 101/423
(58) Field of Search ..... 101/425, 424, 101/423; 15/256.2, 256.51, 255.5; 399/34, 123, 343, 345, 353

(56) References Cited

U.S. PATENT DOCUMENTS 1,654,940 A * 1/1928 Lucas ..... 15/256.52
3,916,426 A * 10/1975 Bown ..... 396/614
4,393,778 A * 7/1983 Kaneko ..... 101/425
4,673,284 A * 6/1987 Matsumoto et al. ..... 399/344
5,009,161 A * 4/1991 Wirz ..... 101/425
5,322,015 A * 6/1994 Gasparrini ..... 101/425
5,575,211 A 11/1996 Harrison ..... 101/425
6,061,867 A * 5/2000 Schorpp et al. ..... 15/308

FOREIGN PATENT DOCUMENTS

EP 0461898 12/1991

* cited by examiner

*Primary Examiner*—Anthony H. Nguyen
(74) *Attorney, Agent, or Firm*—Richard M. Goldberg

(57) ABSTRACT

A cleaning device for cleaning blocks clamped on a rotationally driven printing cylinder of a printing machine, the cleaning device including a rotatable cleaning roller, cleaning organs disposed on a periphery of the cleaning roller and which can be placed in contact with a peripheral surface of a printing cylinder, with angular positions of the cleaning organs varying in an axial direction of the cleaning roller, and the cleaning organs, in each angular position, are disposed on the periphery of the cleaning roller in only a single axial section of the cleaning roller, and control equipment for locking the cleaning organs in different angular positions.

17 Claims, 1 Drawing Sheet

PRINTING MACHINE WITH BLOCK-CLEANING DEVICE

BACKGROUND OF THE INVENTION

The invention relates to a printing machine with a printing cylinder, the rotation of which can be driven, and a cleaning device for the local cleaning of blocks, clamped on the printing cylinder, for which the cleaning device is constructed as a rotatable cleaning roller, which can be placed in contact with the peripheral surface of the printing cylinder and is equipped with cleaning organs, so that the angular positions of the cleaning organs vary in the axial direction of the cleaning roller.

For a printing machine, especially for a flexographic printing machine, there is increasing contamination of the blocks during the printing operation due to dust on the material being printed, due to the dust in the surrounding air and due to drying residues of ink. The dirt is deposited especially on the edges of the raised, printing parts of the blocks. Especially when a finely structured pattern, such as letters in a very small font or halftone images with a fine grid of points, is being printed, the lower lying, not printing parts of the blocks can easily become blocked as the dirt builds up, so that the quality of the printed image is affected.

From the EP-A-0 461 898 there is a printing machine with a cleaning device of the type named above, for which the cleaning roller is a brush roller, which is equipped with helically disposed bristles. The bristles are disposed in several turns on the periphery of the cleaning roller. The cleaning roller is caused to rotate by fictional contact with the rotating printing cylinder, so that the whole surface of the printing cylinder is cleaned uniformly. In one embodiment, the cleaning roller is divided into several axial segments, which can be placed, independently of one another, in contact with the printing cylinder, so that a concerted cleaning of particularly contaminated places on the printing cylinder becomes possible. However, a complicated mechanism is required in order to make or break contact between the individual segments of the cleaning roller and the printing cylinder. In addition, small gaps, in which the surface of the printing cylinder cannot be cleaned, remain between the individuals segments of the cleaning roller.

From the U.S. Pat. No. 5,575,211 there is a cleaning device with a continuous row of bristles, which are stationary at the periphery of the printing cylinder. The cleaning action comes about here owing to the fact that the surface of the rotating printing cylinder is moved past the row of bristles.

In general, cleaning devices are also known, for which the cleaning organs are formed not by bristles but, for example, by section orifices, compressed air nozzles or spraying nozzles for cleaning fluid.

SUMMARY OF THE INVENTION

It is an object of the invention to create a printing machine of the type named above, which has a simplified construction and makes possible a simple adjustment to the region of the printing cylinder, which is to be cleaned.

This objective is accomplished owing to the fact that the cleaning organs in every angular position, are disposed on the periphery of the cleaning roller only on a single, axial section of the same and that the cleaning roller can be locked in different angular positions by control equipment.

For the inventive printing machine, an angular position of the cleaning roller is assigned to each axial section of the printing cylinder by a special arrangement of the cleaning organs. In this angular position, the cleaning organs brush exclusively over this section of the printing cylinder, when the peripheral surface of the printing cylinder moves past the cleaning roller. With the help of the control equipment, the axial section of the printing cylinder, which is to be cleaned, can be determined in a simple manner in that the cleaning roller is locked in the corresponding angular position. If an inspection of the printed product reveals that the block must be cleaned in a different axial region of the printing cylinder, the adjustment of the cleaning device can be made in a very simple manner, in that the cleaning roller is twisted somewhat and then locked in the new angular position. Independently of the position of the section that is to be cleaned, the cleaning roller can at all times be in contact as a whole with the printing cylinder, so that the construction of the construction of the mechanism, making or breaking contact, is simplified considerably.

Advantageous developments of the invention arise out of the dependent claims.

Preferably, the cleaning organs are formed by bristles. However, they may also be formed, for example, by cloths, rags, threads or sponge-like material.

Preferably, the cleaning organs are disposed on the periphery of the cleaning roller in the form of a continuous helical line with, at most, one complete turn. A maximum cleaning action is then achieved at the point, at which the helical line faces the surface of the printing cylinder. Since the distance of the helical line to the surface of the printing cylinder and, with that, the contacting force of the cleaning organs, decreases from this point in both axial directions, the cleaning action decreases steadily in both directions, so that there are no sharp transitions between regions of the surface of the printing cylinder, which have and have not been cleaned. Preferably, the helical line has exactly one turn, so that the total angular range of 360° of the cleaning roller can be utilized for a precise setting of the axial position, which is effective for the cleaning.

The control equipment for locking the cleaning roller in different angular positions preferably is formed by a stepper motor, so that the position, effective for the cleaning, can be set simply by a command to the stepper motor to shift the cleaning roller into the desired angular position. If a larger axial section of the printing cylinder is to be cleaned, the angular position of the cleaning roller can also be varied during the cleaning operation, so that the position, effective for the cleaning, is "wobbled" over an appropriate axial region of the printing cylinder.

In one embodiment of the invention, the position, in which the cleaning roller or brush is in contact with the printing cylinder, is located, in the direction of rotation of the printing cylinder, between the printing position, in which the blocks deliver their ink to the material being printed, and the ink-application position, at which the blocks are inked by an ink-application roller or anilox roller.

In a different embodiment, the cleaning position, in the direction of rotation of the printing cylinder, is located between the ink-application position and the printing position. In this case, the raised portions of the block, which are inked with printing ink, are brushed over by the bristles of the cleaning brush. It was seen that this procedure also does not lead to a noteworthy impairment of printing quality. The action of the cleaning brush consists essentially therein, that the contamination, deposited at the edges of the printing parts of the blocks, is caused to flake off with the help of the bristles of the cleaning brush and is flung away. In this case, the cleaning action is supported owing to the fact that the blocks are moistened by the solvent-containing printing ink.

The mechanism for making and breaking contact between the brush and the printing cylinder, for example, a pneumatic or hydraulic control mechanism, preferably is constructed so that the pressure of the brushes can be adjusted. For example, especially if the blocks are cleaned during the printing operation, it is possible to adjust the brush pressure so that, on the one hand, the desired cleaning effect is achieved and, on the other, the printed image is not affected excessively.

BRIEF DESCRIPTION OF THE DRAWINGS

In the following, an example of the invention is explained by means of the drawings, in which.

DETAILED DESCRIPTION

Figure 1:
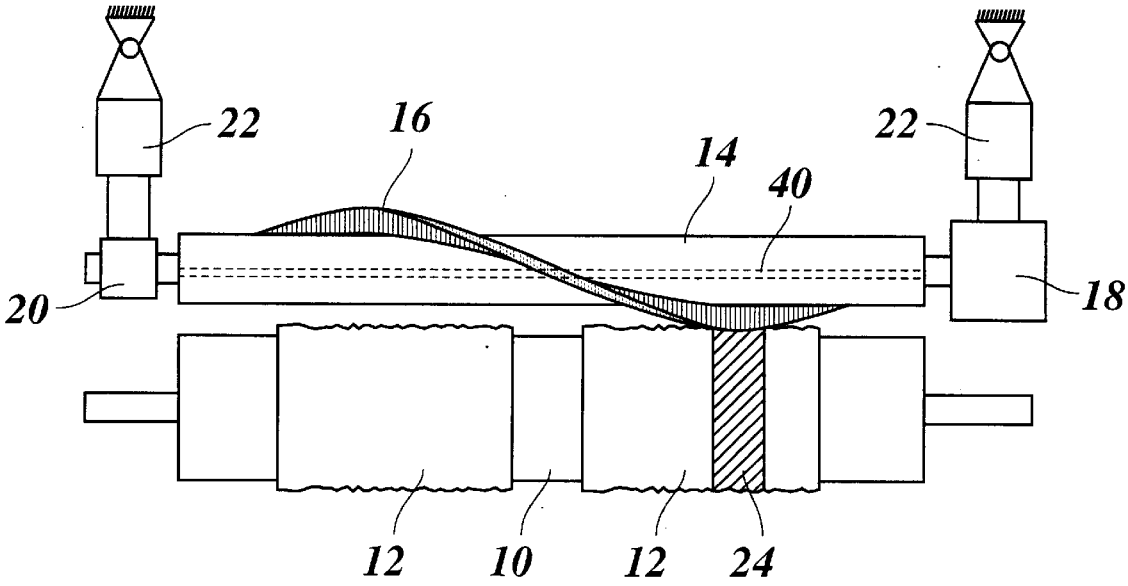
FIG. 1 shows a front view of a printing cylinder and an associated cleaning roller and FIG. 2 shows a diagrammatic sketch of a printing machine with the cleaning device of FIG. 1.

FIG. 1 shows a printing cylinder 10 of a printing machine, such as a flexographic printing machine, on the peripheral surface of which several blocks 12 are clamped. A cleaning roller 14, which is equipped with a helically extending row of bristles 16, runs parallel to the printing cylinder 10. The row of bristles 16 extends over the whole of the axial length of the cleaning roller 14 and runs in an almost complete turn about the periphery of the cleaning roller 14.

The cleaning roller 14 can be rotated about its longitudinal axis and locked sensitively in different angular positions with the help of a stepper motor 18. The stepper motor 18 and a bearing 20 at the opposite end of the cleaning roller 14 are held by pneumatic operating cylinders 22, with which the cleaning roller 14 can be placed radially against the printing cylinder 10. The extension length of the operating cylinders 22 can be adjusted, so that the contacting force of the brushes of row 16 against the surface of the blocks 12 can be set as required.

In each angular position of the cleaning roller 14, the row of bristles 16 lies in only a relatively narrow axial section 24 against the surface of one of the blocks 12, so that only this section 24 is cleaned selectively. The boundaries of section 24 are not defined sharply, since the row of bristles 16, because of the curvature of the cleaning roller 14, constantly moves away from the surface of the block 12. If a different axial section of one of the blocks 12 is to be cleaned, the angular position of the cleaning roller 14 is changed with the help of the stepper motor 18, so that the row of bristles 16 comes into contact with one of the blocks 12 in a new position.

Figure 2:
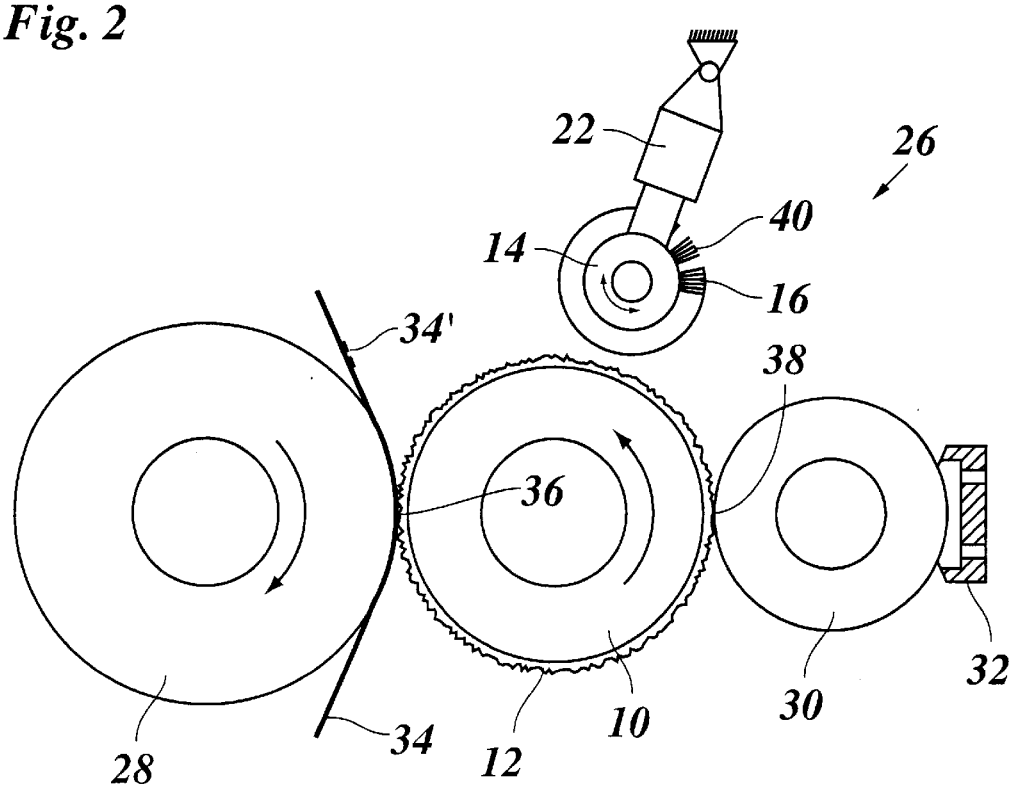

FIG. 2 shows a complete inking system 26 of the flexographic printing machine, with a counter-pressure cylinder 28, the printing cylinder 10, on the peripheral surface of which the blocks 12 are clamped, an anilox roller 30 and a chambered doctor blade 32. A sheet of material 34, which is to be printed and is pulled off from a roll, which is not shown, is passed over the counter-pressure cylinder 28 and, at a printing position 36, passes through a gap formed between the printing cylinder 10 and the counter-pressure cylinder 28.

The counter-pressure cylinder 28, the printing cylinder 10 and the anilox roller 30 can be driven, preferably with individual driving mechanisms. The counter-pressure cylinder 28 is disposed in the stationery frame of the printing machine, which is not shown. On the other hand, the printing cylinder 10 and the anilox roller 30 can be set down transversely to their axis of rotation relative to the counter-cylinder 28 and to one another, so that, in case of need, it is possible to exchange the printing cylinder and/or the anilox roller 30. Moreover, the printing cylinder 10 can also be exchanged for a printing cylinder with a different diameter, in order to change the printing machine over to a different printing length.

The anilox roller 30 has a fine grid of cells on its periphery, and, on passing through the chambered doctor blade 32, is inked with printing ink. At an ink application position 38, in which the anilox roller 30 rolls on the printing cylinder 10, the printing ink, supplied in the cells to the anilox roller 30, is transferred to the raised, printing part of the blocks 12. After approximately half a revolution of the printing cylinder 10, the ink is then transferred in the printing position 36 to the material 34, which is to be printed.

In the course of the printing operation, at a particularly critical position of one of the blocks 12, there is sometimes a deposition of dirt and/or dried ink at the edges of the printing part of the blocks as well as in the spaces between these printing parts. In order to remove this contamination at the blocks, the cleaning roller 14, which is shown in FIG. 2 remote from the printing cylinder, is placed against the latter. In so doing, the angular position of the cleaning roller is selected so that the row of bristles 16 brushes selectively over the critical area of the blocks.

During the normal operation of the printing machine, the counter-pressure cylinder 28 and the printing cylinder 10 are driven in the direction indicated by the arrows in FIG. 2. The material 34, which is to be printed, is pulled continuously from the roll. When the supply on the roll is consumed, the roll is changed in the known manner. For this purpose, a new roll with material, which is to be printed, is inserted and the new sheet of material is connected by gluing with the old sheet at a seam 34". A certain longitudinal section of the sheet 34, which contains the adhesive seam, is later on severed as wastage. While this section passes through the printing position 36, the cleaning roller 14 is brought into the active position, in which the row of bristles 16 contacts the printing cylinder 10 with a suitable brush pressure. Because of the rotation of the printing cylinder, the blocks 12 are brushed with the help of the stationery row of bristles 16, so that the contamination, present at the edges and in the recesses of the block, is removed. After one or more revolutions of the printing cylinder 10, the cleaning roller 14 is put back into the inactive position, so that the printing process can be continued without loss of time.

Since rolls must be changed at regular intervals, such as every 15 minutes in the case of a high-speed printing machine, the cleaning of the blocks in the manner described can also be repeated every 15 minutes, so that larger accumulations of dirt cannot be formed on the blocks 12. Accordingly, an essentially constant, high printing quality is achieved.

In the case of blocks, which are particularly susceptible to contamination and/or in the case of sheets of material, which are to be printed and are particularly dusty, it may be desirable to carry out the block-cleaning procedure at shorter intervals than the exchange of rolls. This is also possible with the cleaning device, in that the cleaning roller 14 is brought briefly into the active position even while the printing operation is running.

In the example shown, the cleaning roller 14 engages the blocks 12 at a position, which is between the ink application position 38 and the printing position 36 in the direction of rotation of the printing cylinder 10. The row of bristles 16 accordingly brushes over the inked, raised parts of the blocks. However, the brush pressure can be adjusted finely so that the printing ink is not removed from the printing part of the blocks, so that an acceptable printed image is obtained even during the cleaning of the blocks. While the bristles brush over the blocks, they are bent slightly and spring back somewhat, when they penetrate into the non-printing spaces between the blocks. At the same time, the contamination adhering to the edges of the blocks is removed effectively.

In a deviation from the Example shown in FIG. 2, it is also possible to let the cleaning roller 14 engage between the printing position 36 and the ink application position 38 in the direction of rotation of the printing cylinder 10, so that the blocks are bushed off after they have transferred their printing ink to the material which is to be printed and before they are inked once again by the anilox roller 32. This can be achieved owing to the fact that, in FIG. 2, the cleaning roller 14 is disposed not above but below the printing cylinder 10 or owning to the fact that the directions of rotation of the counter-pressure cylinder, the printing cylinder and the anilox roller are reversed. If the cleaning roller 14 is disposed below the printing cylinder 10, the dirt particles, which have been brushed off, can fall down without contaminating the blocks once again.

In the example shown, the row of bristles 16 forms a continuous helical line. On the other hand, in a modified version, it is also possible to arrange several rows of bristles, which run parallel or at an angle to the axis, in staggered fashion on the periphery of the cleaning roller 14.

In the example shown, the cleaning roller 14 furthermore has a linear, continuous row of bristles 40, with which it is possible to clean the printing cylinder 10 over the whole of its width.

What is claimed is:

1. A cleaning device for cleaning blocks clamped on a rotationally driven printing cylinder of a printing machine, the cleaning device comprising:

a rotatable cleaning roller, and cleaning organs disposed on a periphery of the cleaning roller and which can be placed in contact with a peripheral surface of a printing cylinder, with angular positions of the cleaning organs varying in an axial direction of the cleaning roller, and the cleaning organs, in each angular position, are disposed on the periphery of the cleaning roller in only a single axial section of the cleaning roller, and control equipment for locking the cleaning organs in different angular positions.

2. The cleaning device of claim 1, wherein the cleaning organs are disposed in the form of a helical line with at most one complete turn on the periphery of the cleaning roller.

3. The cleaning device of claim 2, wherein the cleaning organs are formed by bristles.

4. The cleaning device of claim 2, wherein the control equipment includes a stepper motor.

5. The cleaning device of claim 2, further comprising a device for forcing the cleaning roller with an adjustable contacting pressure against the printing cylinder.

6. The cleaning device of claim 2, further comprising additional cleaning organs disposed continuously in a straight line at a particular position of the periphery of the cleaning roller in order to clean the printing cylinder uniformly over an entire width thereof.

7. The cleaning device of claim 1, wherein the cleaning organs are formed by bristles.

8. The cleaning device of claim 7, wherein the control equipment includes a stepper motor.

9. The cleaning device of claim 7, further comprising a device for forcing the cleaning roller with an adjustable contacting pressure against the printing cylinder.

10. The cleaning device of claim 7, further comprising additional cleaning organs disposed continuously in a straight line at a particular position of the periphery of the cleaning roller in order to clean the printing cylinder uniformly over an entire width thereof.

11. The cleaning device of claim 1, wherein the control equipment includes a stepper motor.

12. The cleaning device of claim 11, further comprising a device for forcing the cleaning roller with an adjustable contacting pressure against the printing cylinder.

13. The cleaning device of claim 11, further comprising additional cleaning organs disposed continuously in a straight line at a particular position of the periphery of the cleaning roller in order to clean the printing cylinder uniformly over an entire width thereof.

14. The cleaning device of claim 1, further comprising a device for forcing the cleaning roller with an adjustable contacting pressure against the printing cylinder.

15. The cleaning device of claim 14, wherein the device includes a pneumatic control mechanism.

16. The cleaning device of claim 14, wherein the device includes a hydraulic control mechanism.

17. The cleaning device of claim 1, further comprising additional cleaning organs disposed continuously in a straight line at a particular position of the periphery of the cleaning roller in order to clean the printing cylinder uniformly over an entire width thereof.

* * * * *